US012779530B2

(12) United States Patent
Masuda et al.

(10) Patent No.: US 12,779,530 B2
(45) Date of Patent: Nov. 3, 2026

(54) CONTINUOUS CASTING START TIMING DETERMINATION METHOD, CONTINUOUS CASTING FACILITY OPERATION METHOD, SLAB MANUFACTURING METHOD, DETERMINING DEVICE, CONTINUOUS CASTING START DETERMINATION SYSTEM, AND DISPLAY TERMINAL DEVICE

(71) Applicant: JFE Steel Corporation, Tokyo (JP)

(72) Inventors: Ryosuke Masuda, Tokyo (JP); Naoya Shibuta, Tokyo (JP); Taiga Koriyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 7 days.

(21) Appl. No.: 18/832,809

(22) PCT Filed: Jan. 25, 2023

(86) PCT No.: PCT/JP2023/002318
§ 371 (c)(1),
(2) Date: Jul. 24, 2024

(87) PCT Pub. No.: WO2023/145786
PCT Pub. Date: Aug. 3, 2023

(65) Prior Publication Data

US 2025/0108433 A1 Apr. 3, 2025

(30) Foreign Application Priority Data

Jan. 27, 2022 (JP) ..... 2022-011171

(51) Int. Cl.
*B22D 11/16* (2006.01)
*B22D 11/08* (2006.01)

(52) U.S. Cl.
CPC ..... *B22D 11/161* (2013.01); *B22D 11/081* (2013.01)

(58) Field of Classification Search
CPC ..... B22D 11/16; B22D 11/161; B22D 11/081; B22D 11/201; B22D 11/202; B22D 11/20–207
See application file for complete search history.

(56) References Cited

FOREIGN PATENT DOCUMENTS

JP H07-328755 A 12/1995
JP H08-019844 A 1/1996
(Continued)

OTHER PUBLICATIONS

English machine translation of JP-H1190589-A (Year: 1999).*
(Continued)

*Primary Examiner* — Keith Walker
*Assistant Examiner* — Steven S Ha
(74) *Attorney, Agent, or Firm* — Buchanan Ingersoll & Rooney PC

(57) ABSTRACT

A continuous casting start timing determination method, a continuous casting facility operation method, a slab manufacturing method, a determining device, a continuous casting start determination system, and a display terminal device are provided. A continuous casting start timing determination method for determining a continuous casting start timing includes: a measurement step of measuring temperatures in a copper plate of a casting mold in the continuous casting facility, by use of a plurality of temperature sensors provided in a casting-direction determination position as a predetermined casting-direction position on the copper plate; and a determination step of determining the start timing based on a casting-direction position of a molten metal surface of molten steel, the casting-direction position being estimated based on measurement results in the mea-
(Continued)

surement step and a width of a slab to be cast in the continuous casting facility.

19 Claims, 9 Drawing Sheets

(56) References Cited

FOREIGN PATENT DOCUMENTS

| | | | | |
|---|---|---|---|---|
| JP | H0819844 | A | * | 1/1996 |
| JP | H1190589 | A | * | 4/1999 |
| JP | H11123516 | A | | 5/1999 |
| JP | 3098426 | B2 | | 10/2000 |
| JP | 2004276050 | A | | 10/2004 |
| JP | 2012170999 | A | | 9/2012 |

OTHER PUBLICATIONS

Int'l Search Report (PCT/ISA/210) w/ translation & Written Opinion (PCT/ISA/237) mailed on Apr. 11, 2023, by the Japanese Patent Office in Int'l App. No. PCT/JP2023/002318. (8 pages).
Extended European Search Report issued Mar. 31, 2025, by the European Patent Office in corresponding European Patent Application No. 23746996.0-1103. (13 pages).
Notification of Transmittal of Translation of the International Preliminary Report on Patentability (Form PCT/IB/338 and Form PCT/IB/373) and an English translations of the Written Opinion of the International Searching Authority (Form PCT/ISA/237) issued Aug. 8, 2024, by the International Bureau of WIPO in corresponding International Application No. PCT/JP2023/002318. (6 pages).

* cited by examiner

CONTINUOUS CASTING START TIMING DETERMINATION METHOD, CONTINUOUS CASTING FACILITY OPERATION METHOD, SLAB MANUFACTURING METHOD, DETERMINING DEVICE, CONTINUOUS CASTING START DETERMINATION SYSTEM, AND DISPLAY TERMINAL DEVICE

CROSS REFERENCE TO RELATED APPLICATIONS

This is the U.S. National Phase application of PCT/JP2023/002318, filed Jan. 25, 2023, which claims priority to Japanese Patent Application No. 2022-011171, filed Jan. 27, 2022, the disclosures of these applications being incorporated herein by reference in their entireties for all purposes.

FIELD OF THE INVENTION

The present invention relates to a continuous casting start timing determination method, a continuous casting facility operation method, a slab manufacturing method, a determining device, a continuous casting start determination system, and a display terminal device.

BACKGROUND OF THE INVENTION

In a steel continuous casting facility, molten steel continuously poured from a tundish is cooled by a casting mold in which a water cooling tube is embedded, and after that, the molten steel is drawn from a lower portion of the casting mold and further cooled, so that a slab is manufactured. At the time of starting continuous casting, a dummy bar is inserted into a lower opening of the casting mold, and molten steel is poured into the casting mold with a head portion of the dummy bar being taken as a bottom surface. After the molten steel has reached a predetermined level, the dummy bar is drawn out to start the continuous casting.

At the time of starting the drawing of the dummy bar, it is important that a solidifying shell is sufficiently formed on the outer side of a slab and solidifies moderately. When the drawing is started in an insufficient solidified state, so-called breakout in which steel leakage is caused due to breakage of the solidifying shell might occur. In the meantime, when the drawing is started in an excessively solidified state, it is difficult to remove the dummy bar, and this becomes a factor to inhibit transition to a usual operation.

In this respect, a method of starting continuous casting for the purpose of automation from starting of pouring molten steel into a casting mold to starting of drawing is proposed. For example, PTL 1 describes a method that focuses on the fact that the solidification degree of a slab in a casting mold depends on a retention time of molten steel in the casting mold from a molten-steel pouring start timing to a drawing start timing. In the method, a molten metal surface level is measured by a vortex sensor, and drawing is started at the timing when the molten metal surface level reaches a drawing start level after a predetermined retention time has passed after the start of pouring molten steel.

PATENT LITERATURE

PTL 1: JP 3098426 B

SUMMARY OF THE INVENTION

However, in the method of detecting the molten metal surface level by the vortex sensor like PTL 1, detection accuracy might decrease due to noise such as vibrations of a continuous casting facility. This might cause a case where casting is started even though the molten metal surface level does not reach a molten metal surface level at which drawing should be started, or a case where casting cannot be started even though the molten metal surface level has reached the molten metal surface level at which drawing should be started.

In view of this, aspects of the present invention are accomplished in view of the above problem, and an object according to aspects of the present invention is to provide a continuous casting start timing determination method, a continuous casting facility operation method, a slab manufacturing method, a determining device, a continuous casting start determination system, and a display terminal device each of which can determine a continuous casting start timing with accuracy.

One aspect of the present invention provides a continuous casting start timing determination method for determining a continuous casting start timing as a timing of drawing a dummy bar in a continuous casting facility, the continuous casting start timing determination method including: a measurement step of measuring temperatures in a copper plate of a casting mold in the continuous casting facility, by use of a plurality of temperature sensors provided in a casting-direction determination position as a predetermined casting-direction position on the copper plate; and a determination step of determining the start timing based on a casting-direction position of a molten metal surface of molten steel, the casting-direction position being estimated based on measurement results in the measurement step and a width of a slab to be cast in the continuous casting facility.

(2) In the continuous casting start timing determination method in (1), in the determination step, when a ratio of temperatures exceeding a threshold A to the temperatures measured by the plurality of temperature sensors in the casting-direction determination position is equal to or more than a given ratio, it is determined that the molten metal surface has reached the casting-direction determination position, and the start timing is determined based on a determination result that the molten metal surface has reached the casting-direction determination position.

(3) In the continuous casting start timing determination method in (2), in the determination step, when a state where the molten steel is determined to have reached the casting-direction determination position continues for a predetermined period of time, it is determined that the start timing has come.

(4) In the continuous casting start timing determination method in (3), in the determination step, when a duration time of the state where the molten steel is determined to have reached the casting-direction determination position is equal to or more than a threshold C, it is determined that the start timing has come, and when the duration time is less than the threshold C, it is determined that the start timing has not come yet. The threshold C is set based on a table value classified in accordance with a rising speed of a molten metal surface level or a function of the rising speed of the molten metal surface level.

(5) In the continuous casting start timing determination method according to any one of (1) to (4), in the determination step, only temperatures measured by temperature sensors within the width of the slab are used from among the plurality of temperature sensors in the casting determination position.

(6) In the continuous casting start timing determination method according to any one of (1) to (5), in the determination step, only temperatures measured by temperature sensors provided in a copper plate on a long side of the slab are used from among the plurality of temperature sensors in the casting determination position.

(7) In the continuous casting start timing determination method according to any one of (1) to (6), in the measurement step, the temperatures in the copper plate are measured further by use of a plurality of temperature sensors provided in at least one casting-direction position different from the casting-direction determination position. In the determination step, it is determined whether or not the molten steel has reached the at least one casting-direction position, based on measurement results of temperatures in the at least one casting-direction position and the width of the slab. The continuous casting start timing determination method further includes a display step of displaying a determination result indicative of whether or not the molten steel has reached the casting-direction determination position and the at least one casting-direction position.

(8) One aspect of the present invention provides a continuous casting facility operation method including drawing the dummy bar and starting continuous casting when it is determined that the starting timing has come by use of the continuous casting start timing determination method according to any one of (1) to (7).

(9) One aspect of the present invention provides a slab manufacturing method using the continuous casting facility operation method when a slab is manufactured by use of a continuous casting facility.

(10) One aspect of the present invention provides a determining device for determining a continuous casting start timing as a timing of drawing a dummy bar in a continuous casting facility. The determining device includes: a plurality of temperature sensors provided in a casting-direction determination position as a predetermined casting-direction position in a copper plate of a casting mold in the continuous casting facility, the plurality of temperature sensors being configured to measure temperatures in the copper plate; and a drawing start determination section configured to determine the start timing based on a casting-direction position of a molten metal surface of molten steel, the casting-direction position being estimated based on measurement results from the plurality of temperature sensors and a width of a slab to be cast in the continuous casting facility.

(11) One aspect of the present invention provides a continuous casting start determination system for determining a continuous casting start timing as a timing of drawing a dummy bar in a continuous casting facility. The continuous casting start determination system includes: a determination server device; and a display terminal device. The determination server device includes: a plurality of temperature sensors provided in a casting-mold width direction in each of a plurality of casting-direction positions including a casting-direction determination position as a predetermined casting-direction position on a copper plate of a casting mold of the continuous casting facility, the plurality of temperature sensors being configured to measure temperatures in the copper plate; a drawing start determination section configured to determine the start timing based on a casting-direction position of a molten metal surface of molten steel, the casting-direction position being estimated based on measurement results from the plurality of temperature sensors and a width of a slab to be cast in the continuous casting facility; and a molten metal surface level information output unit configured to output molten metal surface level information indicative of a molten metal surface level state including the casting-direction position of the molten metal surface of the molten steel which casting-direction position is estimated by the drawing start determination section. The display terminal device includes: a display data acquisition unit configured to acquire the molten metal surface level information; and a displaying unit configured to display, based on the acquired molten metal surface level information, a molten metal surface state of each position which molten metal surface state corresponds to temperature data in each casting-direction position, and reference data to estimate the molten metal surface state.

(12) One aspect of the present invention provides a display terminal device constituting a continuous casting start determination system together with a determination server device for determining a continuous casting start timing as a timing of drawing a dummy bar in a continuous casting facility. The display terminal device includes: a display data acquisition unit configured to acquire molten metal surface level information indicative of a molten metal surface level state including a casting-direction position of a molten metal surface of molten steel which casting-direction position is estimated by the determination server device; and a displaying unit configured to display, based on the acquired molten metal surface level information, a molten metal surface state of each position which molten metal surface state corresponds to temperature data in each casting-direction position, and reference data to estimate the molten metal surface state. The server device estimates the casting-direction position of the molten metal surface of the molten steel based on a width of a slab to be cast in the continuous casting facility and measurement results from a plurality of temperature sensors provided in a casting-mold width direction in each of a plurality of casting-direction positions including a casting-direction determination position as a predetermined casting-direction position on a copper plate of a casting mold in the continuous casting facility, the plurality of temperature sensors being configured to measure temperatures in the copper plate.

With one aspect of the present invention, it is possible to provide a continuous casting start timing determination method, a continuous casting facility operation method, a slab manufacturing method, a determining device, a continuous casting start determination system, and a display terminal device each of which can determine a continuous casting start timing with accuracy.

DETAILED DESCRIPTION OF EMBODIMENTS OF THE INVENTION

With reference to the drawings, the following detailed description deals with embodiments of the present invention. In the following description, identical or similar constituents have identical or similar reference signs, and redundant descriptions are omitted. Each drawing is schematic and includes a case different from actual one. Each embodiment described below describes a device or a method to embody the technical idea according to aspects of the present invention, and the technical idea according to aspects of the present invention does not specify a material, a structure, an arrangement, and the like of a component part to those described below. Various changes can be added to the technical idea according to aspects of the present invention within a technical scope defined by claims described in Claims.

A continuous casting start timing determination method according to one embodiment of the present invention will be described. In the present embodiment, a continuous casting start timing in a continuous casting facility 1 for continuously casting molten steel is determined. In such a continuous casting facility 1, a slab is manufactured in such a manner that continuous casting is started by drawing a dummy bar at a start timing (described later).

Device Configuration of Continuous Casting Facility

Figure 1:
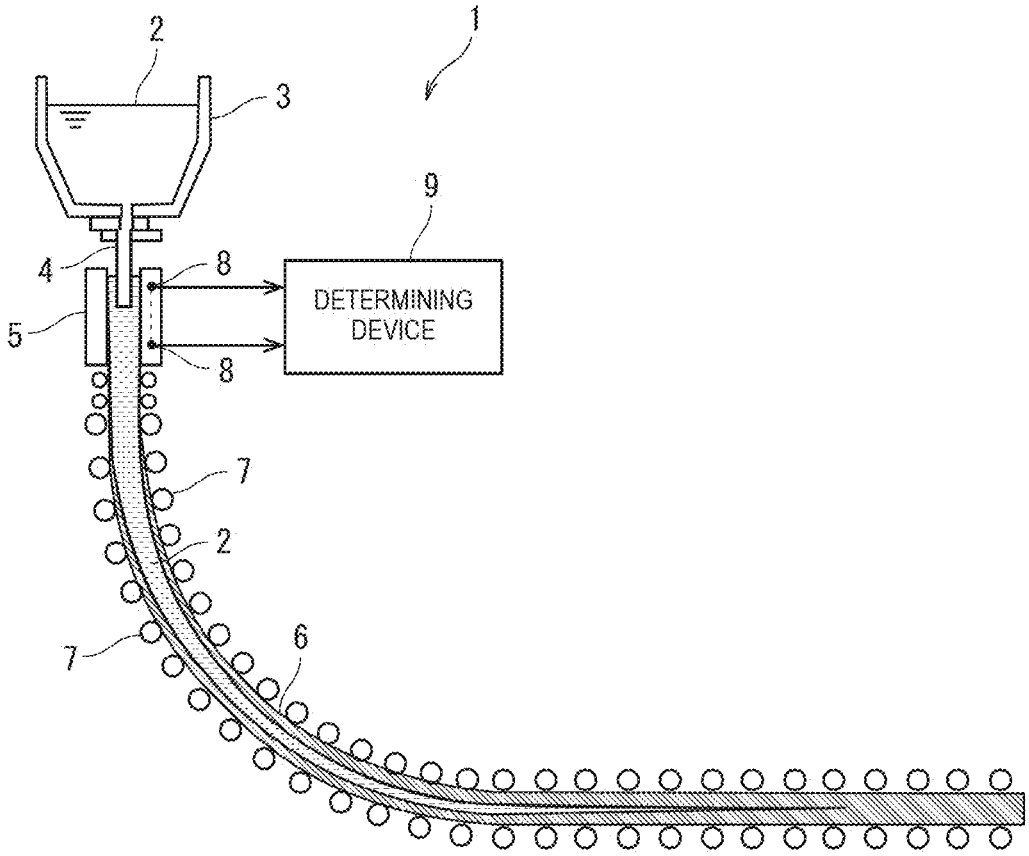
FIG. 1 is a schematic view illustrating a continuous casting machine in one embodiment of the present invention.

As illustrated in FIG. 1, the continuous casting facility 1 includes a tundish 3 into which molten steel 2 is poured, a copper casting mold 5 for cooling the molten steel 2 poured from the tundish 3 via an immersion nozzle 4, a plurality of slab support rolls 7 for conveying a semi-solidified slab 6 drawn from the casting mold 5, a plurality of temperature sensors 8 provided on a long-side surface and a short-side surface of the casting mold 5, and a determining device 9 for determining a continuous casting start timing based on detection temperatures from the temperature sensors 8 thus provided. Further, the casting mold 5 includes a coil (not illustrated) for generating an electromagnetic mixing magnetic field that turns a molten metal surface.

Figure 2:
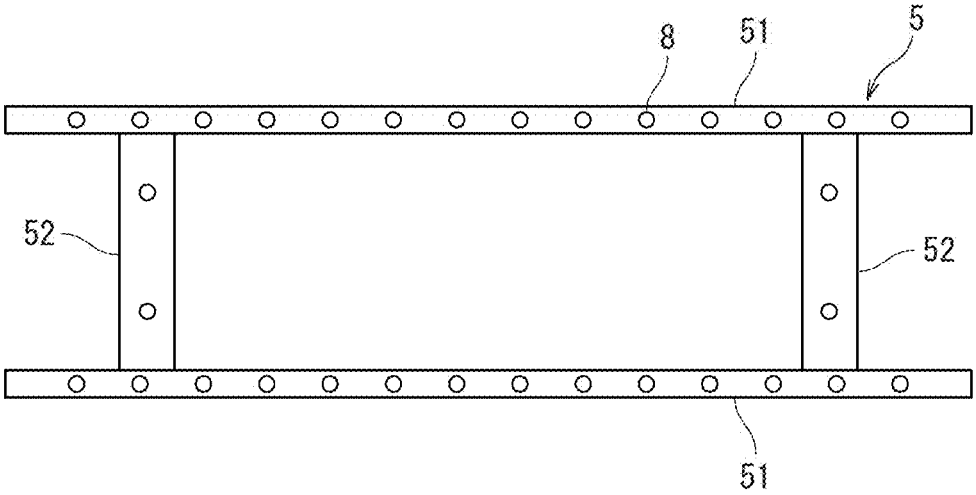
FIG. 2 is an explanatory view illustrating an exemplary arrangement of a casting mold and temperature sensors.
Figure 3:
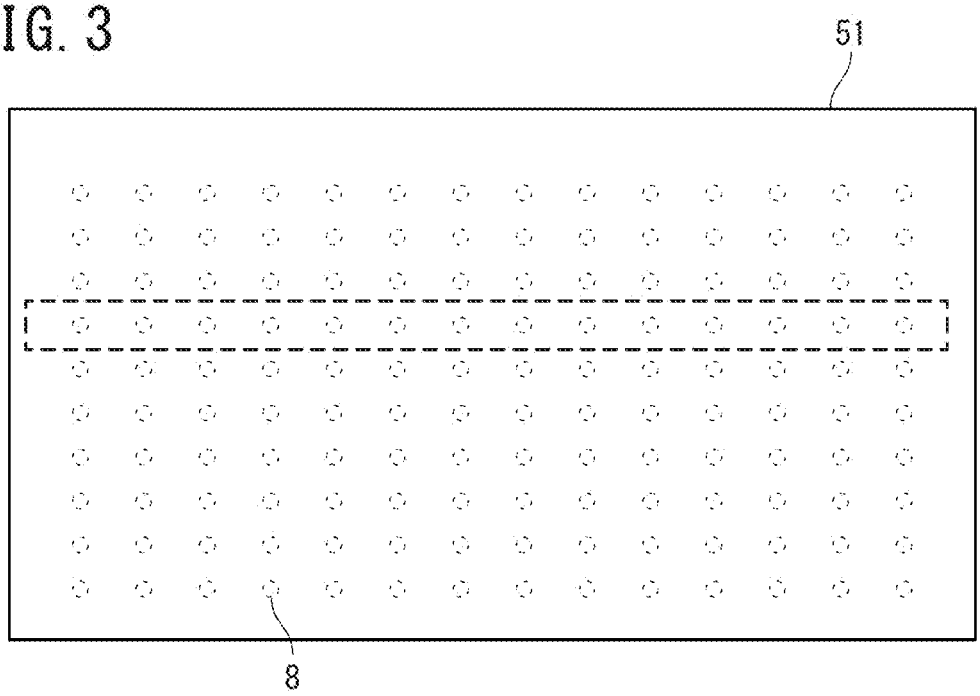
FIG. 3 is a schematic view illustrating installation positions of the temperature sensors provided in a copper plate on a long side.

As illustrated in FIG. 2, the casting mold 5 is configured such that two copper plates 52 on narrow-side surfaces are sandwiched between two copper plates 51 on long-side surfaces. Further, the plurality of temperature sensors 8 is provided inside the copper plates 51 and the copper plates 52. The plurality of temperature sensors 8 is arranged horizontally in each of a plurality of positions along a casting direction of the casting mold 5. That is, with reference to the copper plate 51 as an example as illustrated in FIG. 3, in terms of a casting-direction position as a position in the casting direction (the up-down direction in FIG. 3) of the copper plate 51, the temperature sensors 8 are provided in a plurality of casting-direction positions. Further, in each casting-direction position, a plurality of temperature sensors 8 is provided horizontally (the right-left direction in FIG. 3). This also applies to the copper plate 51, and the copper plate 51 and the copper plate 52 have the same casting-direction positions in which the temperature sensors 8 are provided. Further, the casting mold 5 is configured such that the copper plates 52 on the short-side surfaces are movable in the right-left direction in FIG. 2 so that the width (a slab width) of the slab 6 to be cast is adjustable.

The temperature sensor 8 is not particularly limited, provided that the temperature of the casting mold 5 can be measured, but, for example, a thermoelectric couple may be used, or an optical-fiber sensor may be used. For example, in a case where the temperature sensor 8 is an optical-fiber sensor, optical fibers are inserted from respective upper end surfaces of the copper plates 51, 52 in a slab casting direction (that is, a drawing direction) such that the optical fibers are parallel to respective molten-steel-side surfaces of the copper plates 51, 52. It is preferable that this type be applied to a case where the copper plate 51 on the long side in the continuous casting facility 1 has a flat surface like a vertical-bending slab continuous casting machine. Further, respective installation positions of temperature measurement points of the temperature sensors 8 in the thickness direction of the copper plate 51, 52 are set such that all the temperature measurement points have the same distance from the molten-steel-side surface of the copper plate 51, 52 and each temperature measurement point is placed between the molten-steel-side surface of the copper plate 51, 52 and a coolant slit (a water channel where a coolant for cooling the copper plate flows).

Figure 4:
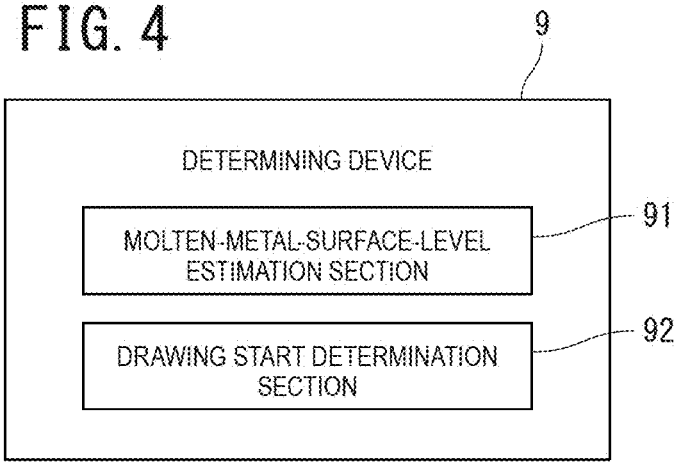
FIG. 4 is a block diagram illustrating the configuration of a determining device.

The continuous casting facility 1 further includes the determining device 9 for determining a continuous casting start timing based on measurement results from the plurality of temperature sensors 8, as illustrated in FIG. 4. The determining device 9 is constituted by an information processing device such as a computer, and when an arithmetic processing unit such as a CPU (Central Processing Unit) thereinside executes a computer program, the determining device 9 functions as a molten-metal-surface-level estimation section 91 and a drawing start determination section 92. The number of temperature sensors 8 provided in the same casting-direction position is not particularly limited, but, from the viewpoint of measurement accuracy, it is preferable that the number of temperature sensors 8 that can perform measurement in the slab width of a slab to be cast be 10 or more, as will be described later.

Start Timing Determination Method

Figure 5:
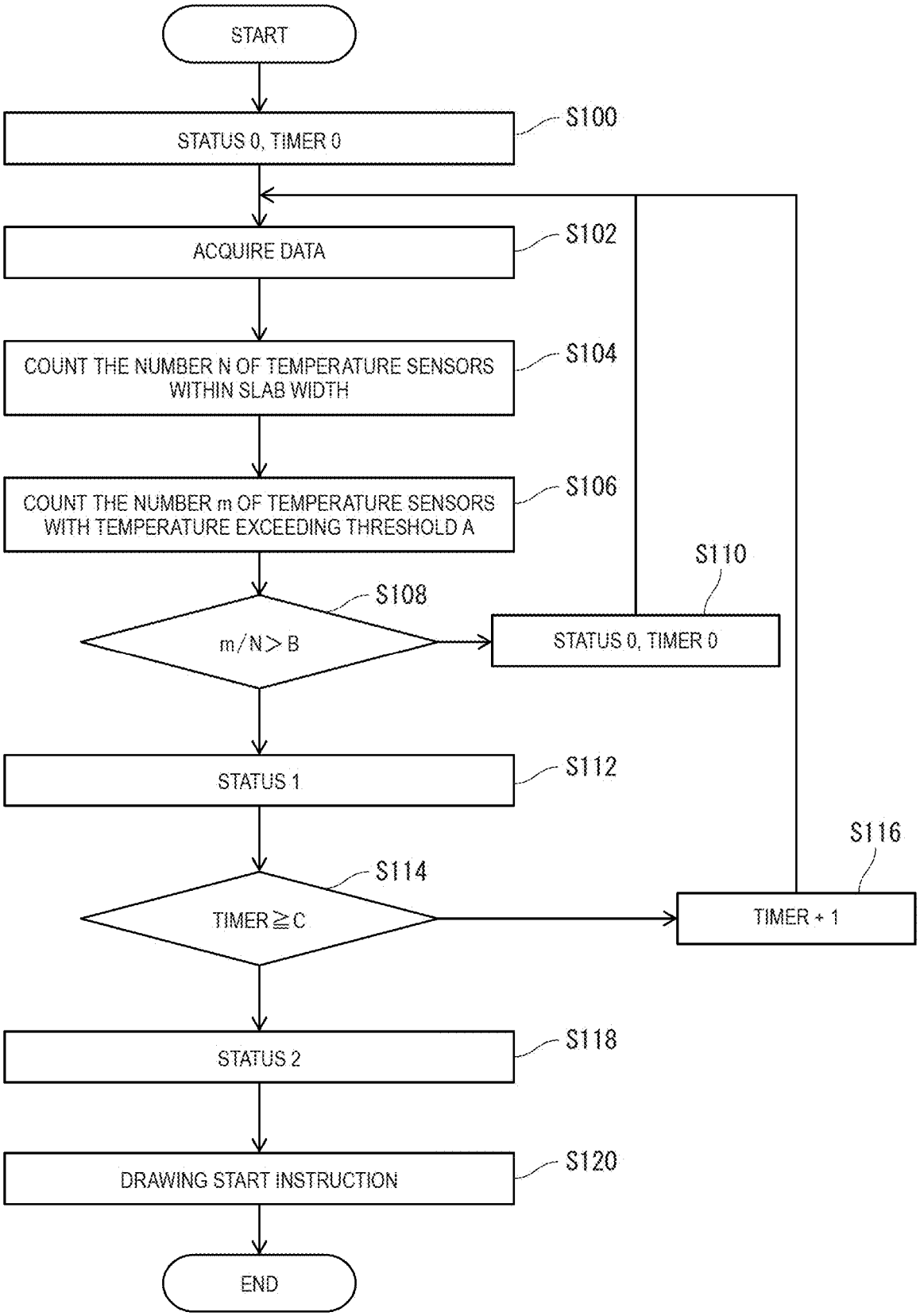
FIG. 5 is a flowchart illustrating a continuous casting start timing determination method according to one embodiment of the present invention.

In the present embodiment, a continuous casting start timing is determined to start continuous casting, in accordance with a determination process in a processing flow illustrated in FIG. 5. Note that the determination process illustrated in FIG. 5 starts at the timing when an execution command for start timing determination is input into the determining device 9. For example, the execution command for start timing determination is input at a pouring start timing of the molten steel 2 from the immersion nozzle 4 to the casting mold 5 or is input in response to an operation by an operator.

In the determination process of determining the continuous casting start timing illustrated in FIG. 5, first, the drawing start determination section 92 outputs status 0 and timer 0 as initial values, as the process of step S100. As the status, there are three statuses 0, 1, and 2. Note that, at the timing when the status reaches 2, an instruction to start drawing of the dummy bar is given. Hereby, the process of step S100 is completed, and the determination process proceeds to the process of step S102.

As the process of step S102, the temperatures of the copper plates 51, 52 of the casting mold 5 are measured by the temperature sensors 8, and after that, the molten-metal-surface-level estimation section 91 acquires data on the temperatures of the measured copper plates 51, 52 and a slab width (a measurement step). Hereby, the process of step S102 is completed, and the determination process proceeds to the process of step S104.

As the process of step S104, the molten-metal-surface-level estimation section 91 counts the number N of temperature sensors present within the slab width from among the plurality of temperature sensors 8, by use of the data on the slab width, acquired in the process of step S102, and temperature-sensor installation coordinate data prepared in advance. As illustrated in FIG. 2, the casting mold 5 is configured such that the two copper plates 52 on short-side surfaces are sandwiched between the two copper plates 51 on long-side surfaces, and in a case where the slab width is narrow, the temperature sensors 8 provided in end parts of the copper plates 51 on the long-side surfaces are placed outside the copper plates 52 on the short-side surfaces. Accordingly, the temperature sensors 8 of the copper plates 51 which temperature sensors 8 are placed outside the copper plates 52 have low temperatures even during casting. On this account, it is difficult for such temperature sensors 8 to determine whether or not the molten metal surface reaches a given level for the temperature sensors 8, and such temperature sensors 8 should not be used for the determination. In view of this, such temperature sensors 8 are excluded in advance in step S104. Hereby, the process of step S104 is completed, and the determination process proceeds to the process of step S106.

In the process of step S106, the molten-metal-surface-level estimation section 91 counts the number m of sensors having a temperature exceeding a threshold A, in terms of a plurality of temperature sensors 8 disposed in a predetermined casting-direction position from among the temperature sensors 8 extracted in the process of step S104. The casting-direction position is a distance from the upper end of the copper plate 51, 52 in the casting direction but may be a distance from the upper end of the copper plate 51, 52 in a vertical direction. The predetermined casting-direction position is a casting-direction position suitable as a molten metal surface height in the casting mold 5 when continuous casting is started and is, for example, a molten metal surface height (a meniscus position) in a steady state of the continuous casting or a casting-direction position around the molten metal surface height. Note that the predetermined casting-direction position is also called a casting-direction determination position. For example, in the example illustrated in FIG. 3, the fourth position in the temperature sensors 8 from the upper end of the copper plate is taken as the casting-direction determination position (a region with a square shape indicated by a broken line). In terms of the temperature sensors 8 to be used, a height position (a casting-direction position) from the upper end of the copper plate can be set to an appropriate number, but it is preferable that the number N of temperature sensors 8 disposed within the slab width from among the temperature sensors 8 in the same casting-direction position be 10 or more. Hereby, the process of step S106 is completed, and the determination process proceeds to the process of step S108. The threshold A is set as a value based on which the arrival of the molten steel 2 at the casting-direction position where the temperature sensors 8 of the copper plate 51, 52 are provided is detectable, and the threshold A is set appropriately based on the distance of the temperature sensors 8 from the surface of the copper plate, the material of the copper plate 51, 52, or the like.

In the process of step S108, the molten-metal-surface-level estimation section 91 determines whether or not the ratio of the temperature sensors 8 having a temperature exceeding the threshold A to the plurality of temperature sensors 8 in the casting-direction determination position is equal to or more than a given ratio. That is, the molten-metal-surface-level estimation section 91 determines whether or not a value obtained by diving the number m of sensors having a temperature exceeding the threshold A by the number N of temperature sensors 8 within the slab width is equal to or more than a threshold B. In this determination, when it is determined whether or not the ratio of temperatures measured in the casting-direction determination position is equal to or more than a given ratio, it is determined whether or not the molten metal surface of the molten steel 2 has reached the casting-direction determination position. In the determination of step S108, when the value is less than the threshold B, the determination process proceeds to the process of step S110, and when the value is equal to or more than the threshold B, the determination process proceeds to the process of step S112. It is preferable that the threshold B be set as a value based on which the molten steel 2 can be determined to have reached the casting-direction determination position, and the threshold B is set based on the detection accuracy of the temperature sensors 8, or the like. The molten metal surface before the drawing starts may be largely uneven in both the width direction and the thickness direction. Accordingly, in a case where the threshold B is extremely close to 1, a timing to determine that the molten metal surface has reached the casting-direction determination position might be delayed, so that the drawing start might be delayed to decrease productivity, or the molten steel might overflow from the casting mold. In the meantime, in a case where the threshold B is very small, a risk of wrongly determining that the molten metal surface has reached the casting-direction determination position even though an average molten metal surface level (the casting-direction position or the height-direction position of the molten metal surface in the casting mold 5) does not reach the casting-direction determination position increases. Accordingly, it is preferable that the threshold B be set to a value equal to or more than 0.5 but equal to or less than 0.9.

In the process of step S110, the drawing start determination section 92 outputs status 0 and timer 0, and the determination process returns to the process of step S102.

In the meantime, in the process of step S112, the drawing start determination section 92 outputs status 1, and the determination process proceeds to the process of step S114.

In the process of step S114, the drawing start determination section 92 determines whether the timer is equal to or more than a threshold C. That is, in step S114, it is determined whether or not a state where the molten metal surface is determined to have reached the casting-direction determination position continues for a predetermined period of time. Note that the value of the timer indicates a duration time of the state where the molten metal surface is determined to have reached a casting-direction determination position. When the value is less than the threshold C, it is determined that the start timing has not come yet, and the determination process proceeds to step S116. In the meantime, when the value is equal to or more than the threshold C, it is determined that the start timing has come, and the determination process proceeds to the process of step S118. It is preferable that the threshold C be set as a value based on which a solidifying shell can be determined to be sufficiently formed in the molten steel 2 reaching the casting-direction determination position to such an extent that the molten steel 2 can resist drawing. The threshold C may be set appropriately based on cooling power of the casting mold 5, past performance data, or the like. For example, it is possible to estimate the rising speed of the average molten metal surface level based on the opening degree of a sliding nozzle between the tundish 3 and the immersion nozzle 4, and the width and the thickness of the slab. In a case where the threshold C is excessively large, the molten steel might overflow from the casting mold. In the meantime, in a case where the threshold C is excessively small, drawing might be started in a non-solidified state, that is, in a state where the solidifying shell is not formed sufficiently. Accordingly, it is preferable that the threshold C be set to be equal to or more than 5 seconds but equal to or less than 15 seconds based on a table value classified in accordance with the rising speed of the molten metal surface level or the function of the rising speed of the molten metal surface level.

In the process of step S116, the drawing start determination section 92 outputs a value obtained by increasing the timer by one second, and the determination process returns to the process of step S102. Note that, in the present embodiment, the temperature measurement by the temperature sensors 8 in the measurement step of step S102 is performed consecutively every one second, and a series of the processes of steps S102 to S116 is also performed every one second.

In the process of step S118, the drawing start determination section 92 outputs status 2, and the determination process proceeds to the process of step S120.

In the process of step S120, the drawing start determination section 92 gives a dummy bar drawing start instruction and finishes a series of determination processes. Note that the determination processes of steps S104 to S114 are also called a determination step. That is, in the present embodiment, after the measurement step in step S102, the determination step in steps S104 to S114 is performed. When the processing flow illustrated in FIG. 5 is finished, continuous casting is started, so that the slab 6 is manufactured in the continuous casting facility 1.

The start timing determination method according to the present embodiment is to determine a start timing based on the casting-direction position of the molten metal surface, and when the start timing is determined by use of the threshold B and the threshold C based on measurement results from the temperature sensors 8 within the slab width, it is possible to determine, with accuracy, whether or not the molten metal surface has reached the casting-direction determination position and time has passed sufficiently. Further, in comparison with a case where the molten metal surface is detected by use of a vortex sensor, the molten metal surface is detected by use of the temperature sensors 8 provided in the casting mold 5, and therefore, the molten metal surface is not affected by vibrations of the continuous casting facility, or the like, thereby making it possible to detect the molten metal surface with higher accuracy. Further, when the molten steel 2 is poured into the casting mold 5 at the start of continuous casting, the poured molten steel 2 might be scattered in the casting mold 5 to increase temperatures even in a casting-direction position higher than the height of the molten metal surface, the temperatures being measured by the temperature sensors 8. However, with the start timing determination method according to the present embodiment, the molten metal surface is determined by use of the threshold B and the threshold C, and therefore, it is possible to determine, with accuracy, whether or not the molten metal surface has reached a predetermined casting-direction position even in such a case. This makes it possible to determine the continuous casting start timing with accuracy.

Further, the start timing determination method according to the present embodiment uses the measurement results from the plurality of temperature sensors 8 arranged horizontally. Hereby, a large fluctuation in the molten metal surface of the molten steel in the width direction or the thickness direction can be considered. In the meantime, in a case where the temperature sensors are arranged unidimensionally in the casting direction, it is difficult to accurately detect the molten metal surface of the molten steel when the molten metal surface largely fluctuates in the width direction or the thickness direction, so that it is difficult to determine the start timing with accuracy.

Modifications

Aspects of the present invention have been described with reference to a particular embodiment, but this is not intended to limit the invention by these descriptions. Other embodiments of the present invention including various modifications are also apparent to those skilled in the art as well as the embodiment disclosed herein by referring to the description of aspects of the present invention. In view of this, it should be understood that the embodiment of the invention described in claims also covers an embodiment including those modifications described herein solely or in combination.

For example, in the above embodiment, the start timing is determined by use of measurement results from the temperature sensors 8 in the casting-direction determination position as a predetermined casting-direction position, but the present invention is not limited to such an example. In accordance with aspects of the present invention, the start timing may be determined by use of temperature measurement results from the temperature sensors 8 in a plurality of casting-direction positions, and that is, the measurement results in the casting-direction determination position, and measurement results in at least one casting-direction position different from the casting-direction determination position. For example, in addition to the casting-direction determination in the above embodiment, the temperature sensors 8 on the downstream side (the lower side in FIG. 3) in the casting direction from the casting-direction determination position may be also subjected to the processes of steps S100 to S118 similarly to the above embodiment for each casting-direction position to calculate a status. When respective statuses of a plurality of casting-direction positions including the casting-direction determination position reach 2, the drawing start instruction may be given. Further, the status may be calculated for each casting-direction position in terms of the temperature sensors 8 in the casting-direction determination position and at least two casting-direction positions on the upstream side and on the downstream side from the casting-direction determination position. In this case, for example, even in a case where the status in the casting-direction determination position is not 2, when respective statuses in the casting-direction positions on the upstream side and on the downstream side are 2, abnormality may occur in the measurement in the casting-direction determination position. Accordingly, in such a case, the status in the casting-direction determination position may be also assumed 2 based on the statuses in the casting-direction positions on the upstream side and on the downstream side, and the drawing start instruction may be given.

Figure 6:
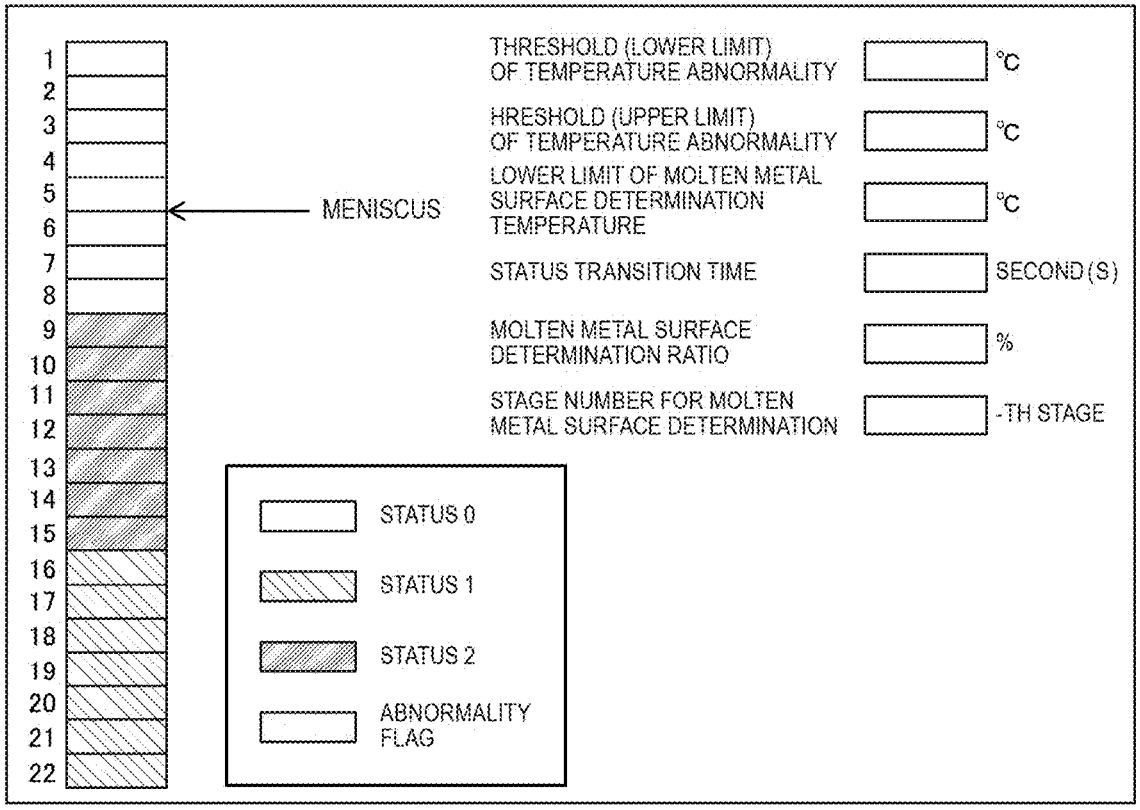
FIG. 6 is an explanatory view illustrating an example of a display method of a status of each casting-direction position in a modification.

Further, in a case where respective statuses are calculated in a plurality of casting-direction positions, a calculation result of the status of each casting-direction position may be displayed. FIG. 6 illustrates an example in which the calculation result of the status of each casting-direction position is displayed. In the example illustrated in FIG. 6, calculation results of respective statuses of the casting-direction positions are indicated by square blocks arranged vertically, and the calculation results are displayed with different display forms of the blocks in accordance with the statuses. Note that the lower side illustrated in FIG. 6 is the downstream side in the casting direction, and the upper side is the upstream side in the casting direction. In the example illustrated in FIG. 6, the temperature sensors 8 are provided in 22 stages as the casting-direction positions, such that the position between the fifth stage and the sixth stage is a meniscus position, and the sixth stage is a casting-direction position right under the meniscus position and is a casting-direction determination position. When the molten steel 2 is poured into the casting mold 5 normally, respective statuses of the blocks change from bottom up from a block (on the 16th stage in FIG. 6) above the dummy bar, and when a casting start timing comes, all statuses below the casting-direction determination position within a range where the molten steel is poured are turned to 2. With such display forms, an operator can find which casting-direction position in the casting mold 5 the molten metal surface of the molten steel has reached, so that the operator can visually recognize the position of the molten metal surface of the molten steel in the casting mold 5. This allows the operator to accurately determine the start timing. Note that information indicative of a molten metal surface level state, including information indicative of which casting-direction position in the casting mold 5 the molten steel has reached (information on the casting-direction position of the molten metal surface of the molten steel), is also called molten metal surface level information. Further, as illustrated in FIG. 6, in addition to the display forms of status 0, 1, 2, an abnormality flag to be displayed as a status in a case where the measured temperature is determined to be abnormal may be displayed. Further, thresholds (upper and lower limits) of temperature abnormality, a molten metal surface determination temperature allowance (the threshold A), a status transition time (the threshold C), a molten metal surface determination ratio (the threshold B), and a stage number for molten metal surface determination (the casting-direction determination position) may be displayed.

Further, in terms of the temperature sensor 8 within the slab width, in a case where its temperature does not rise (poor temperature measurement) even though the temperatures of the other temperature sensors 8 in the same casting-direction position rise, the temperature sensor 8 poor in temperature measurement may not be included in N or the threshold B may be adjusted.

Further, in the above embodiment, the temperature sensors 8 are provided in a plurality of casting-direction positions, but the present invention is not limited to such an example. Similarly to the above embodiment, in a case where the continuous casting start timing is determined only based on the casting-direction determination position as a predetermined casting-direction position, the temperature sensors 8 may be provided only in the casting-direction determination position.

Further, in the above embodiment, the measurement results from the temperature sensors 8 including both the temperature sensors 8 provided in the copper plate 51 on the long side and the temperature sensors 8 provided in the copper plate 52 on the short side are used, but the present invention is not limited to such an example. When drawing of the slab 6 is started, the thickness of a solidifying shell on the long side of the slab 6 often becomes a problem. In view of this, the start timing may be determined by use of only measurement results from the temperature sensors 8 provided in the copper plate 51 on the long side. In this case, the temperature sensors 8 may be provided only in the copper plate 51 on the long side.

Further, in the above embodiment, the determining device 9 has a device configuration illustrated in FIG. 4, but the determining device 9 may include the temperature sensors 8 in addition to this device configuration. That is, in accordance with aspects of the present invention, the determining device 9 for determining the continuous casting start timing may include the molten-metal-surface-level estimation section 91, the drawing start determination section 92, and a plurality of temperature sensors 8.

Further, in the above embodiment, temperature measurement values from the temperature sensors 8 are used, but the present invention is not limited to such an example. For example, the casting-direction determination position may be set in a position where no temperature sensor 8 is provided by estimating a temperature distribution on the copper plate of the casting mold by use of interpolation such as linear interpolation or cubic spline interpolation based on temperature measurement values from the temperature sensors 8 disposed two-dimensionally.

Figure 7:
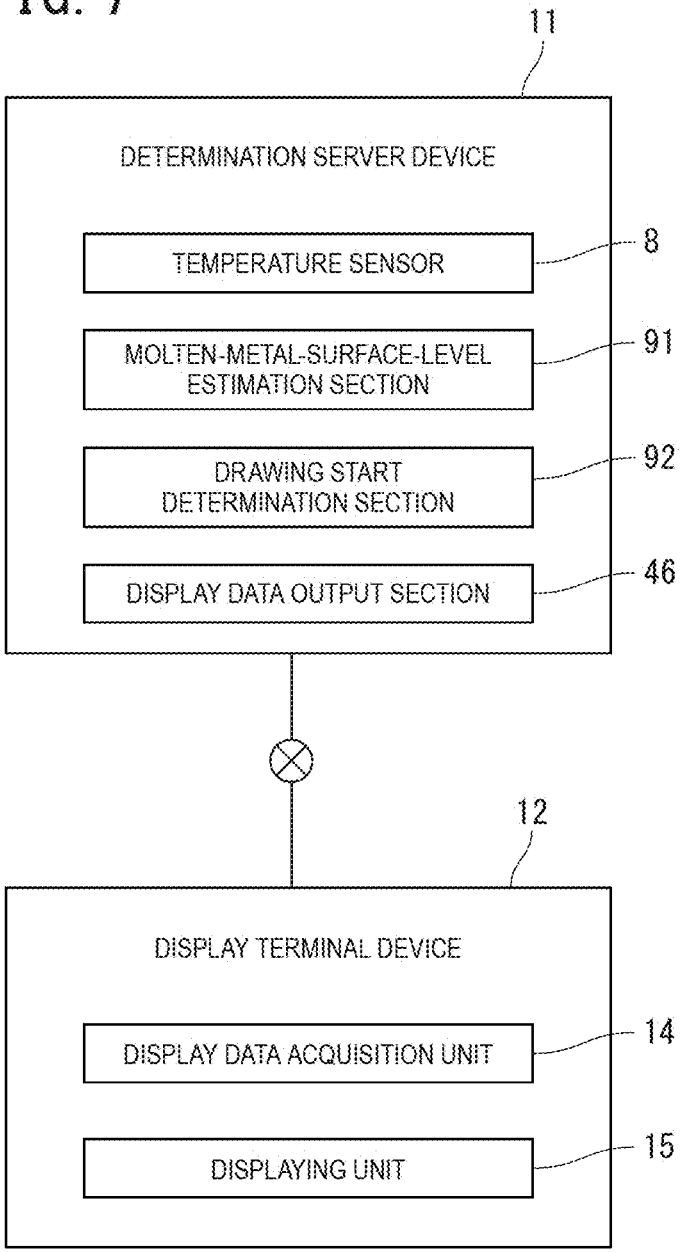
FIG. 7 is a block diagram illustrating the configuration of a continuous casting start determination system.

Furthermore, aspects of the present invention can be also applied to a continuous casting start determination system. In this case, for example, as illustrated in FIG. 7, a continuous casting start determination system 10 includes a determination server device 11 and a display terminal device 12. The determination server device 11 is connected to the display terminal device 12 in a wireless manner or wired manner via a network. The determination server device 11 includes the temperature sensors 8, the molten-metal-surface-level estimation section 91, the drawing start determination section 92, and a display data output section 13. The temperature sensors 8, the molten-metal-surface-level estimation section 91, and the drawing start determination section 92 are configured similarly to those in the above embodiment and other modifications. That is, a plurality of temperature sensors 8 is provided in a casting-mold width direction in each of a plurality of casting-direction positions including the casting-direction determination position as a predetermined casting-direction position on the copper plate of the casting mold 5 in the continuous casting facility 1 and measures temperatures in the copper plate. Further, the molten-metal-surface-level estimation section 91 estimates the casting-direction position of the molten metal surface of the molten steel based on measurement results from the plurality of temperature sensors 8 and the width of the slab 6 to be cast in the continuous casting facility 1. Further, the drawing start determination section 92 determines the start timing based on the estimated casting-direction position of the molten metal surface of the molten steel. The display data output section 13 outputs, to the display terminal device 12, molten metal surface level information indicative of a molten metal surface level state including the estimated casting-direction position of the molten metal surface of the molten steel. Further, the display terminal device 12 includes a display data acquisition unit 14 and a displaying unit 15. The display data acquisition unit 14 acquires the molten metal surface level information from the determination server device 11. The displaying unit 15 displays, based on the acquired molten metal surface level information, a molten metal surface state of each position which molten metal surface state corresponds to temperature data in each casting-direction position, and reference data to estimate a molten metal surface state. The reference data is the threshold B or C or the like to be used in steps S108 or S114. For example, the displaying unit 15 is a display device such as a monitor for displaying information illustrated in FIG. 6 as an image. Further, in addition to the information illustrated in FIG. 6, the displaying unit 15 may display a casting condition, reference data, time-series data of the temperature of the copper plate or the like, as illustrated in FIGS. 8, 9 (described later).

Example

As Example, the inventors of the present invention started continuous casting by use of the start timing determination method according to the above embodiment in a real continuous casting facility 1. In Example, the temperature sensors 8 were provided in a casting-direction determination position right under the meniscus position. In the casting-direction determination position, 38 temperature sensors 8 were provided. The number of temperature sensors 8 within the slab width at the time of continuous casting was 30.

Figure 8:
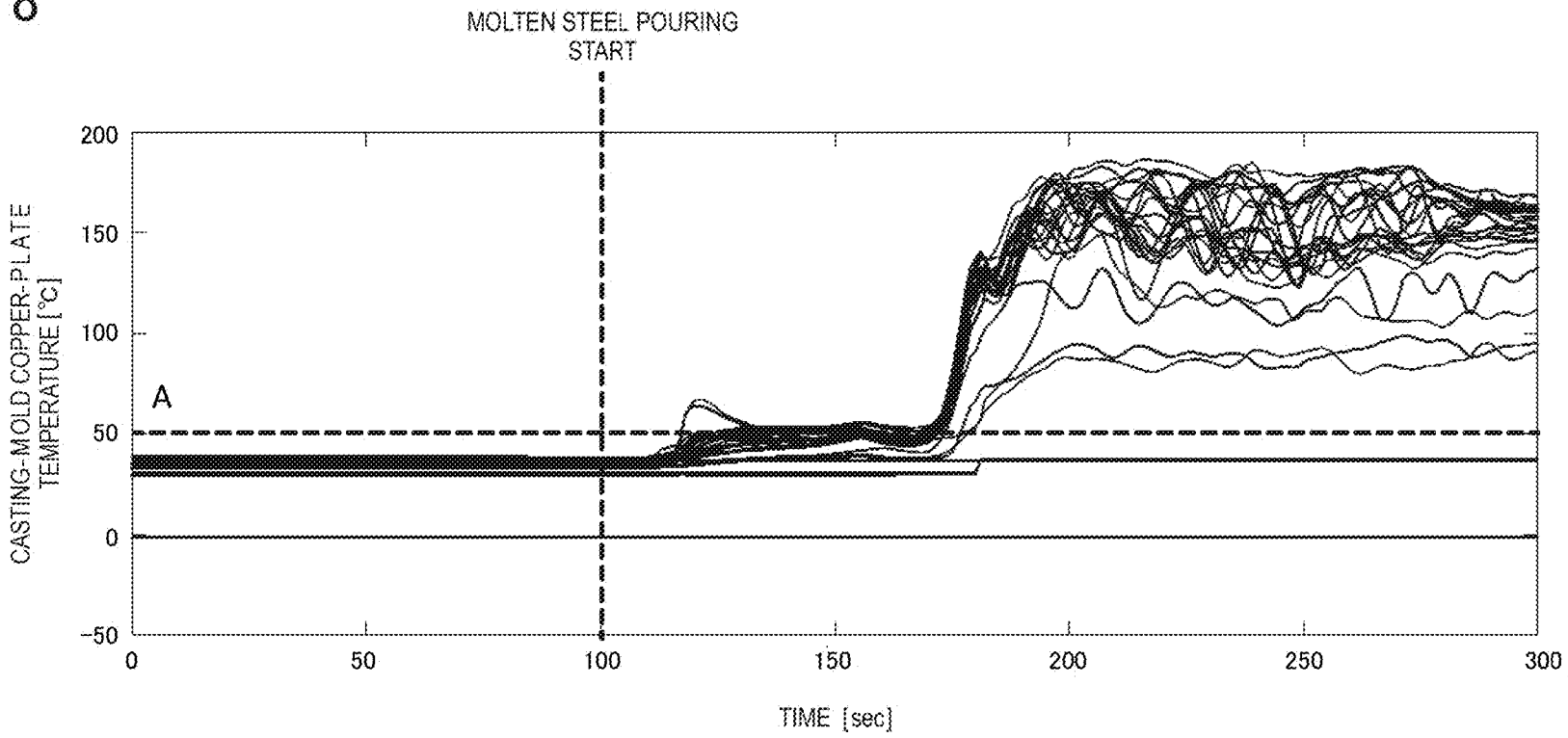
FIG. 8 is a graph illustrating changes over time in a casting-mold copper-plate temperature in a casting-direction determination position in Example.
Figure 9:
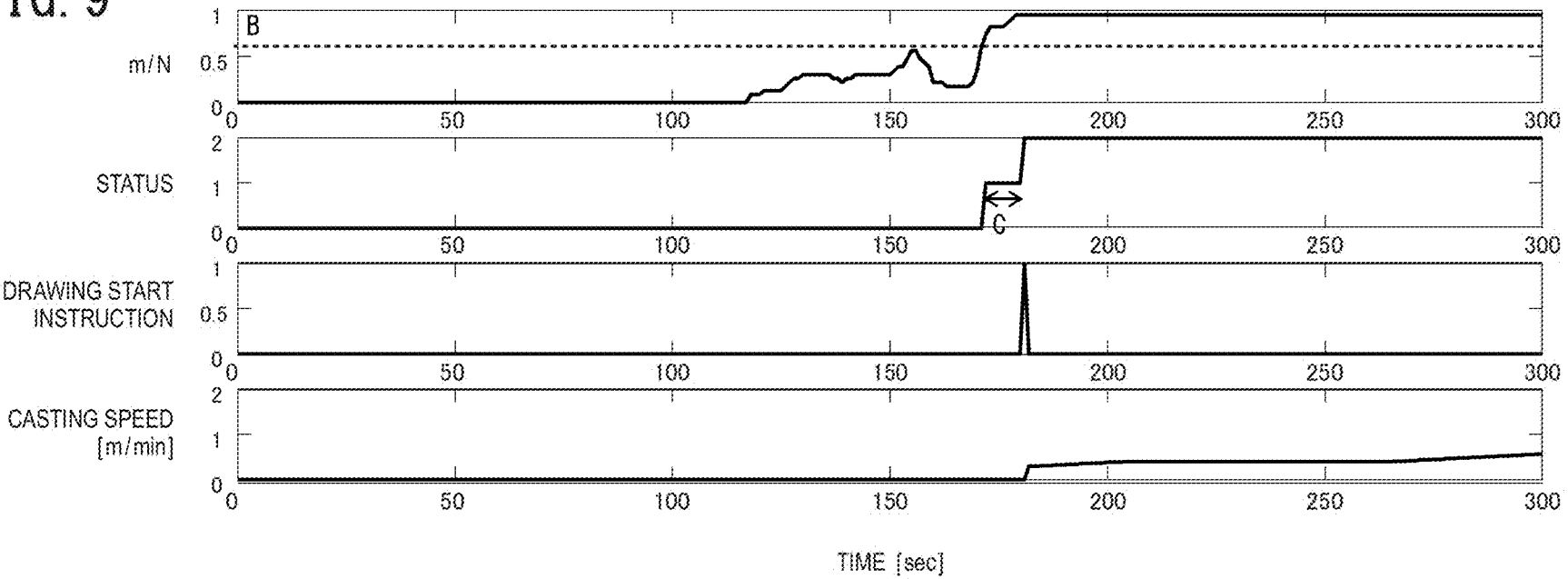
FIG. 9 is an explanatory view illustrating an example in which the continuous casting start timing determination method according to an embodiment of the present invention is applied in Example.

Measurement results from the temperature sensors 8 before and after pouring of the molten steel 2 into the casting mold 5 are illustrated in FIG. 8. As illustrated in FIG. 8, when pouring of the molten steel was started at a timing indicated by a long broken line, detection temperatures from almost all the temperature sensors 8 increased although they were uneven. In this example, the continuous casting start timing determination method according to the above embodiment was applied with a value indicated by a dotted line in the figure was set to 50° C. as the threshold A.

FIG. 9 is a view illustrating an example in which the continuous casting start timing determination method according to the above embodiment was applied based on the temperature data in FIG. 8. FIG. 9 illustrates changes over time in a value obtained by dividing the number m of temperature sensors 8 having a temperature exceeding the threshold A by N, a status output from the drawing start determination section 92, a drawing start instruction, and a casting speed in an actual operation. In this example, the threshold B for m/N was 0.6, and the threshold C for a timer transitioning from status 1 to status 2 was 10 seconds.

In this example, the drawing start instruction to draw the dummy bar could be given in an appropriate timing, so that no trouble occurred at the start of continuous casting.

REFERENCE SIGNS LIST

1 continuous casting facility
2 molten steel
3 tundish
4 immersion nozzle
5 casting mold
51, 52 copper plate
6 slab
7 slab support roll
8 temperature sensor
9 determining device
91 molten-metal-surface-level estimation section
92 drawing start determination section
10 continuous casting start determination system
11 determination server device
12 display terminal device
13 display data output section
14 display data acquisition unit
15 displaying unit

The invention claimed is:

1. A continuous casting start timing determination method for determining a continuous casting start timing as a timing of drawing a dummy bar in a continuous casting facility, the continuous casting start timing determination method comprising:

a measurement step of measuring temperatures in a copper plate of a casting mold in the continuous casting facility, by use of a plurality of temperature sensors provided in a casting-direction determination position as a predetermined casting-direction position on the copper plate; and a determination step of determining the start timing based on a casting-direction position of a molten metal surface of molten steel, the casting-direction position being estimated based on measurement results in the measurement step and a width of a slab to be cast in the continuous casting facility.

2. The continuous casting start timing determination method according to claim 1, wherein in the determination step, when a ratio of temperatures exceeding a threshold A to the temperatures measured by the plurality of temperature sensors in the casting-direction determination position is equal to or more than a given ratio, it is determined that the molten metal surface has reached the casting-direction determination position, and the start timing is determined based on a determination result that the molten metal surface has reached the casting-direction determination position.

3. The continuous casting start timing determination method according to claim 2, wherein in the determination step, when a state where the molten steel is determined to have reached the casting-direction determination position continues for a predetermined period of time, it is determined that the start timing has come.

4. The continuous casting start timing determination method according to claim 3, wherein:

in the determination step, when a duration time of the state where the molten steel is determined to have reached the casting-direction determination position is equal to or more than a threshold C, it is determined that the start timing has come, and when the duration time is less than the threshold C, it is determined that the start timing has not come yet; and the threshold C is set based on rising speed of a molten metal surface level.

5. The continuous casting start timing determination method according to claim 4, wherein in the determination step, only temperatures measured by temperature sensors within the width of the slab are used from among the plurality of temperature sensors in the casting-direction determination position.

6. The continuous casting start timing determination method according to claim 4, wherein in the determination step, only temperatures measured by temperature sensors provided in a copper plate on a long side of the slab are used from among the plurality of temperature sensors in the casting-direction determination position.

7. The continuous casting start timing determination method according to claim 3, wherein in the determination step, only temperatures measured by temperature sensors within the width of the slab are used from among the plurality of temperature sensors in the casting-direction determination position.

8. The continuous casting start timing determination method according to claim 3, wherein in the determination step, only temperatures measured by temperature sensors provided in a copper plate on a long side of the slab are used from among the plurality of temperature sensors in the casting-direction determination position.

9. The continuous casting start timing determination method 13, according to claim 2, wherein in the determination step, only temperatures measured by temperature sensors within the width of the slab are used from among the plurality of temperature sensors in the casting-direction determination position.

10. The continuous casting start timing determination method according to claim 2, wherein in the determination step, only temperatures measured by temperature sensors provided in a copper plate on a long side of the slab are used from among the plurality of temperature sensors in the casting-direction determination position.

11. The continuous casting start timing determination method according to claim 2, wherein:

in the measurement step, the temperatures in the copper plate are measured further by use of a plurality of temperature sensors provided in at least one casting-direction position different from the casting-direction determination position;

in the determination step, it is determined whether or not the molten steel has reached the at least one casting-direction position, based on measurement results of temperatures in the at least one casting-direction position and the width of the slab; and the continuous casting start timing determination method further includes a display step of displaying a determination result indicative of whether or not the molten steel has reached the casting-direction determination position and the at least one casting-direction position.

12. The continuous casting start timing determination method according to claim 1, wherein in the determination step, only temperatures measured by temperature sensors within the width of the slab are used from among the plurality of temperature sensors in the casting-direction determination position.

13. The continuous casting start timing determination method according to claim 12, wherein in the determination step, only temperatures measured by temperature sensors provided in a copper plate on a long side of the slab are used from among the plurality of temperature sensors in the casting-direction determination position.

14. The continuous casting start timing determination method according to claim 1, wherein in the determination step, only temperatures measured by temperature sensors provided in a copper plate on a long side of the slab are used from among the plurality of temperature sensors in the casting-direction determination position.

15. The continuous casting start timing determination method according to claim 1, wherein:

in the measurement step, the temperatures in the copper plate are measured further by use of a plurality of temperature sensors provided in at least one casting-direction position different from the casting-direction determination position;

in the determination step, it is determined whether or not the molten steel has reached the at least one casting-direction position, based on measurement results of temperatures in the at least one casting-direction position and the width of the slab; and the continuous casting start timing determination method further includes a display step of displaying a determination result indicative of whether or not the molten steel has reached the casting-direction determination position and the at least one casting-direction position.

16. A continuous casting facility operation method, comprising drawing the dummy bar and starting continuous casting when it is determined that the starting timing has come by use of the continuous casting start timing determination method according to claim 1.

17. The continuous casting facility operation method according to claim 8, wherein the continuous casting results in manufacturing a slab.

18. A determining device for determining a continuous casting start timing as a timing of drawing a dummy bar in a continuous casting facility, the determining device comprising:

a plurality of temperature sensors provided in a casting-direction determination position as a predetermined casting-direction position in a copper plate of a casting mold in the continuous casting facility, the plurality of temperature sensors being configured to measure temperatures in the copper plate; and a drawing start determination section configured to determine the start timing based on a casting-direction position of a molten metal surface of molten steel, the casting-direction position being estimated based on measurement results from the plurality of temperature sensors and a width of a slab to be cast in the continuous casting facility.

19. A continuous casting start determination system for determining a continuous casting start timing as a timing of drawing a dummy bar in a continuous casting facility, the continuous casting start determination system comprising:

a determination server device; and a display terminal device, wherein:

the determination server device includes a plurality of temperature sensors provided in a casting-mold width direction in each of a plurality of casting-direction positions including a casting-direction determination position as a predetermined casting-direction position on a copper plate of a casting mold of the continuous casting facility, the plurality of temperature sensors being configured to measure temperatures in the copper plate, a drawing start determination section configured to determine the start timing based on a casting-direction position of a molten metal surface of molten steel, the casting-direction position being estimated based on measurement results from the plurality of temperature sensors and a width of a slab to be cast in the continuous casting facility, and a molten metal surface level information output unit configured to output molten metal surface level information indicative of a molten metal surface level state including the casting-direction position of the molten metal surface of the molten steel which casting-direction position is estimated by the drawing start determination section; and the display terminal device includes a display data acquisition unit configured to acquire the molten metal surface level information, and a displaying unit configured to display, based on the acquired molten metal surface level information, a molten metal surface state of each position which molten metal surface state corresponds to temperature data in each casting-direction position, and reference data to estimate the molten metal surface state.

* * * * *